US010723120B2

(12) United States Patent
Caron et al.

(10) Patent No.: US 10,723,120 B2
(45) Date of Patent: Jul. 28, 2020

(54) INK DELIVERY SYSTEM AND METHOD

(71) Applicant: Goss International Americas, Inc., Durham, NH (US)

(72) Inventors: Glen Roger Caron, Deerfield, NH (US); Brian Joseph Gentle, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 337 days.

(21) Appl. No.: 15/221,405

(22) Filed: Jul. 27, 2016

(65) Prior Publication Data

US 2018/0029354 A1 Feb. 1, 2018

(51) Int. Cl.

| | |
|---|---|
| ***B41F 31/02*** | (2006.01) |
| ***B41F 31/03*** | (2006.01) |
| ***B41F 31/13*** | (2006.01) |

(52) U.S. Cl.

CPC ..... *B41F 31/022* (2013.01); *B41F 31/02* (2013.01); *B41F 31/03* (2013.01); *B41F 31/13* (2013.01)

(58) Field of Classification Search

CPC ..... B41F 31/022; B41F 31/13; B41F 31/02; B41F 31/03; B41F 31/06; B41F 31/08; B41F 31/28; B41P 2251/112

USPC ..... 101/366

See application file for complete search history.

(56) References Cited

U.S. PATENT DOCUMENTS

| | | | | |
|---|---|---|---|---|
| 3,848,529 | A * | 11/1974 | Gegenheimer | B41F 31/04 101/363 |
| 6,085,652 | A * | 7/2000 | Deschner | B41F 31/022 101/148 |
| 6,397,745 | B2 | 6/2002 | Koehler | |
| 6,450,093 | B1 | 9/2002 | Jentzsch et al. | |
| 6,474,233 | B1 * | 11/2002 | Kosciesza | B41F 31/08 101/335 |
| 9,242,454 | B2 | 1/2016 | Rancourt et al. | |
| 2004/0056911 | A1 * | 3/2004 | Fairchild | B41J 25/308 347/8 |
| 2006/0164460 | A1 * | 7/2006 | Uwagaki | B41J 2/16544 347/32 |

FOREIGN PATENT DOCUMENTS

| | | | |
|---|---|---|---|
| DE | 19928228 | A1 | 12/2000 |
| DE | 102013003923 | A1 | 10/2013 |
| EP | 1060887 | A2 | 12/2000 |

* cited by examiner

*Primary Examiner* — Leslie J Evanisko

(74) *Attorney, Agent, or Firm* — Davidson, Davidson & Kappel, LLC; Jennifer L. O'Connell

(57) ABSTRACT

An ink delivery system is provided. The ink delivery system includes at least one ink cartridge dispenser including an ink cartridge holder for holding an ink cartridge storing printing ink, at least one ink level sensor, a rotatable ink fountain roller and an ink fountain blade, forming a dispensed ink area receiving printing ink from the ink cartridge. The ink delivery system also includes a support supporting the at least one ink cartridge dispenser movably across a longitudinal axis of the ink fountain roller. The ink cartridge dispenser is movable along the support and fixable to the support manually. A method for supplying printing ink is also provided.

20 Claims, 2 Drawing Sheets

INK DELIVERY SYSTEM AND METHOD

FIELD OF THE INVENTION

The present invention relates generally to printing press equipment and, more particularly, to ink delivery systems for printing presses.

BACKGROUND

In rotary offset printing presses, a thin film of ink is continuously applied to a printing plate on which there is an ink receptive image. The thin film of ink tends to adhere only to the image portion of the plate. The plate is carried on a rotating cylinder or drum. The printing plate transfers the image directly to a printing substrate or, in the case of offset printing; the printing plate transfers the image to an impression blanket cylinder which subsequently transfers the image to a printing substrate. The printing substrate, for example, paper, is fed along a transport direction in either discrete sheets or a continuous web.

The ink film applied to the printing plate must be of uniform thickness and applied continuously for printing an image of consistent quality on the substrate. To create and deliver this thin film of ink, a train of rollers takes ink from a reservoir known as an ink fountain and smoothens the ink into a continuous and uniform thin film as the ink moves from roller to roller.

Most ink is metered from fountains using a similar method. A blade, is placed under and to one side of a rotating fountain roller. The blade is angled upwardly to trap ink against the fountain roller. The blade is positioned so that a narrow gap is formed between the blade and the fountain roller. As the fountain roller rotates a film of ink adheres to an outer surface thereof. Among other factors, a size of the gap between the fountain roller and the blade determines the amount or thickness of the ink film which is carried by the fountain roller and delivered to the next roller in the ink train. The last inking roller in the train supplies ink to a plate cylinder of a printing unit.

Existing ink delivery systems, such as the Sentinel® system from Pamarco Graphics, use a traversing head that moves along an axis of the fountain roller and dispenses ink in low spots in the ink fountain that may form as result of the viscous nature of ink and a tendency to stick to surfaces of printing inks. An agitator plow is attached to the traversing head, so the ink in low spots in the ink fountain gets agitated when the traversing head is moved along the ink fountain.

U.S. Pat. No. 6,397,745 discloses an ink management system for an offset printing press, including a linear transport, an ink dispenser and an ink fountain level sensor. The linear transport moves the ink dispenser and the ink fountain level sensor across the width of the ink fountain. The linear transport includes a carriage to which the ink dispenser and the ink fountain level sensor are mounted. An actuator moves and positions the carriage along track or rail extending over and across the ink fountain. The ink dispenser includes a cartridge of offset printing press ink, wherein the cartridge has an exit opening in one end through which ink is dispensed and an open end opposite said exit opening. A movable member is disposed within said ink cartridge for dispensing ink from said ink cartridge. Movement of the movable member dispenses ink into an ink fountain through the exit opening. The displacement of the movable member is determined in order to track an amount of ink dispensed during, for example, a printing run.

SUMMARY

One problem of existing ink delivery systems is that they cannot deliver sufficient quantities of ink for wide printing systems running at elevated speeds. Changing ink cartridges in short periods of time is necessary. The existing traversing head design makes it costly and harder to implement a multiple ink dispensing head design to allow for more than one ink cartridge at a time to dispense ink. On wide presses and heavy coverage jobs only having one ink dispensing head is a substantial deficiency. For example on a 75 inch wide press printing a heavy coverage job running at 1500 ft/min, a single eight lb ink cartridge has to be changed every three minutes.

In existing ink delivery systems, only the low spots of ink will get agitated and the whole fountain has to be filled with ink. For example, for spot color jobs or low coverage jobs, it is beneficial to only dispense a very small amount of ink in multiple spots along the ink fountain without ink agitation. However, with one traversing head, the whole ink fountain must be filled.

With the ink delivery system according to the present invention it is possible to dispense very small amounts of ink in specific locations along the ink fountain at the same time. Another advantage of ink delivery system of the present invention is that ink agitation is not dependent on the ink dispensing and can also be turned off if desired.

Another advantage of the present invention is that the frequency of changing ink cartridges can be reduced. For instance, a press operator will find it beneficial to replace five cartridges at one time every 15 minutes instead of replacing one cartridge every three minutes.

Furthermore, the ink delivery system according to the present invention is less expensive and more flexible than known ink delivery systems and can easily be integrated into press control systems.

The present invention provides an ink delivery system, comprising:

at least one ink cartridge dispenser including an ink cartridge holder for holding an ink cartridge storing printing ink;

at least one ink level sensor; and an ink fountain roller and an ink fountain blade, forming a dispensed ink area receiving printing ink from the ink cartridge, the ink fountain roller being rotatable;

a support supporting the at least one ink cartridge dispenser movably across a longitudinal axis of the ink fountain roller, the ink cartridge dispenser movable along the support and fixable to the support manually.

The present invention further provides A method for supplying printing ink to a printing unit of a printing press, comprising:

arranging at least one ink cartridge dispenser carrying an ink cartridge on a support;

moving the at least one ink cartridge dispenser on the linear support by hand across a longitudinal axis of the ink fountain roller;

dispensing printing ink through an open end of the ink cartridge to the dispensed ink area;

rotating the ink fountain roller; and transporting the printing ink to a printing unit in a printing press.

BRIEF DESCRIPTION OF THE DRAWINGS

A preferred embodiment of the present invention will be elucidated with reference to the drawings, in which.

DETAILED DESCRIPTION

Figure 1:
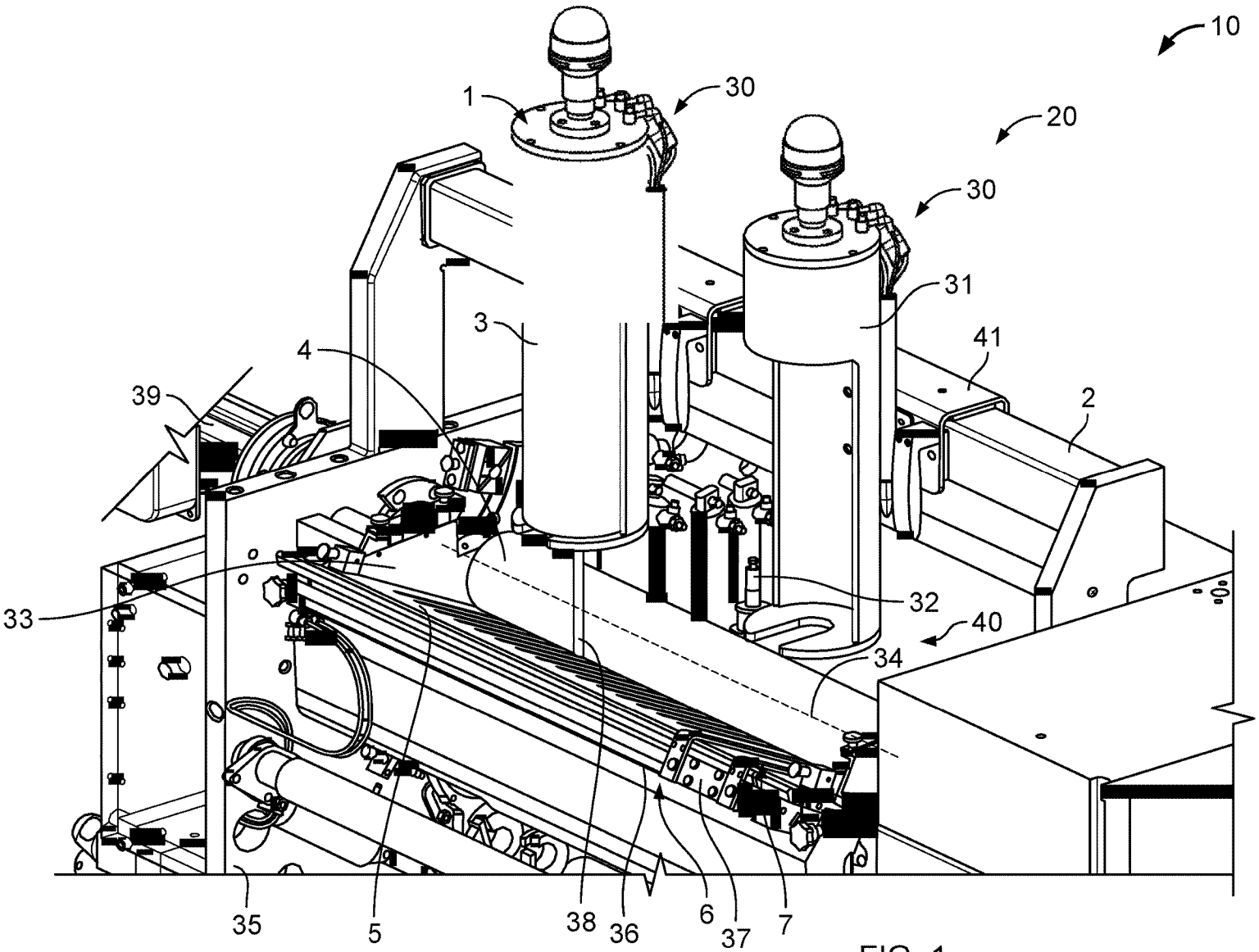
FIGS. 1 and 2 show a printing press equipped with an ink delivery system in accordance with an embodiment of the present invention.
Figure 2:
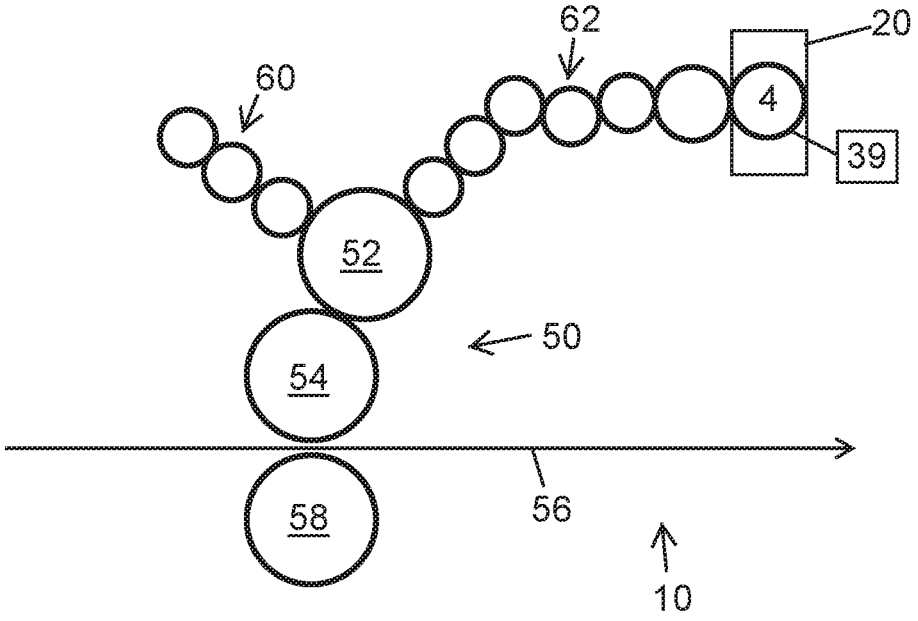

FIGS. 1 and 2 show a printing press 10 equipped with an ink delivery system 20 in accordance with an embodiment of the present invention. Printing press 10 includes at least one printing unit 50 having a plate cylinder 52 and a blanket cylinder 54. The printing unit prints on a substrate, preferably on a web 56 via an impression cylinder 58. A dampening train 60 may provide a fluid to plate cylinder 52 an ink train 62 provides ink from ink fountain roller 4 to plate cylinder 52. Printing press 10 can be an offset printing press or a variable cutoff printing press. Variable cutoff printing presses are able to print a plurality of print jobs having a variety of cutoff lengths. In order to accommodate a variety of cutoff lengths, circumferences of plate and blanket cylinders may be varied, for example, blanket and plate cylinders of different sizes may be employed, existing cylinders may be packed or padded to increase their circumference, or printing plates and blankets having a variety of thicknesses that may be interchanged. The ink delivery system 20 includes ink cartridge dispensers 30 coupled to a rail 2, an ink fountain assembly 40 and an ink agitator assembly 6.

An ink cartridge dispenser 30 in accordance with an embodiment of the present invention includes an ink dispensing head 1, an ink cartridge holder 31 and an ink level sensor 32. The ink dispensing head 1 is connected to the ink cartridge holder 31 and an ink cartridge 3 is inserted into the ink cartridge holder 31, so that an open end 38 of the ink cartridge 3 through which ink exits is directed to an area formed between an ink fountain roller 4 and an ink fountain blade 5. Sides 33 along longitudinal axis 34 of ink fountain roller 4 determine the width of the ink in the area. The ink fountain roller 4, driven by motor 39, rotates the printing ink in the dispensed ink area, taking with it a film of ink adhering to its surface and passing by the blade and transports printing ink to the printing unit of the printing press. The printing ink is either supplied directly or via a group of inking rollers to the plate cylinder.

The ink dispensing head 1 includes means for releasing printing ink from an open end 38 of the ink cartridge 3. The printing ink is dispensed into the dispensed ink area through the open end 38 of ink cartridge 3. Usually, printing ink is released from an ink cartridge by moving a movable member in the ink cartridge in direction of the open end of the ink cartridge. Means to move the movable member in the ink cartridge 3 can be constituted of actuators like pneumatic or hydraulic cylinders, which are actuated in response to a manually sent signal or a signal sent by a press control system. The control of dispensing head 1 and/or the press control system is directly or indirectly connected to the ink level sensor 32, so that ink dispensing head 1 and thus the dispensing of printing ink can be controlled as a function of the ink level in the dispensed ink area. The sensing and processing of these signals can be carried out according to methods known in the art.

Prefilled special or commercially available ink cartridges of any size, carrying any kind of ink, such as offset printing ink, can be used. It is understood by one skilled in the art that any fluid used for printing in printing presses is referred to as printing ink. In this embodiment, the ink level sensor 32 is mounted to a socket on the ink cartridge holder 31, so that the position of the ink level sensor 32 is fixed with respect to the ink cartridge holder 31, ink cartridge 3 and ink dispensing head 1. Thus, the ink level 32 is sensed in a fixed spot of the dispensed ink area when the ink cartridge dispenser 30 is stationary during a print job.

The printing press 10 in this embodiment is a 33.5 inch wide printing unit and the ink delivery system 20 is equipped with two ink cartridge dispensers 30. In one of the two ink cartridge dispensers 30, an ink cartridge 3 is inserted in ink cartridge holder 31, the other one is shown without an ink cartridge inserted. A 75 inch wide printing unit could for example have six ink cartridge dispensers. The number of ink cartridge dispensers can be varied according to the width of the printing unit, the desired ink coverage or the printing speed. Furthermore, different ink cartridge dispensers can be used together in one ink delivery system according to the present invention.

The ink cartridge dispensers 30 are movably coupled to a rail 2. The rail includes means for securely fixing ink cartridge dispensers 30 at their desired positions, so that ink cartridge dispensers 30 are stationary during printing. A releasable clamp 41 actuated manually for example could be used. The ink cartridge dispensers 30 can easily slide along the rail 2 when the means is released so the operator can position them as needed based on the print coverage. This will enable the operator to only feed a very small amount of ink in specific locations during a low coverage or spot color job. Rail 2 is mounted on a frame 35 of the printing press 10 and ink cartridge dispensers 30 can slide parallel to longitudinal axis 34 of ink fountain roller 4 along the dispensed ink area. As ink cartridge dispensers 30 are positioned by hand, low friction between the moving members of rail 2 is advantageous. Furthermore, ink cartridge dispensers 30 and/or rail 2 can be selected or designed to enable quickly removing and/or inserting of ink cartridge dispensers 30, thus reduce set-up time and ease maintenance. Positioning aids, such as stops for ink cartridge dispensers 30 or markings on rail 2 can also be arranged.

To spread the ink out, an ink agitator assembly 6 is arranged at the ink fountain blade 5 and includes at least one agitator blade 7 that extends into the dispensed ink area. A base plate 36 is mounted to the bottom side of ink fountain blade 5. The at least one ink agitator blade 7 is mounted to an agitator blade carrier 37 that can be moved across the whole width of the dispensed ink area by any movement means known in the art. Agitating the ink across the whole width of the dispensed ink area is in particular advantageous for conventional print jobs, where a continuous ink film of uniform thickness is desired. It is also possible to move the at least one agitator blade 7 only in specific desired regions of the dispensed ink area. The at least one agitator blade 7 is interchangeable, so that the shape or material can be adjusted to different ink viscosities or desired agitation intensity.

For print jobs that do not require agitation, for example low coverage jobs or spot jobs, agitation can be turned off or agitator assembly 6 can be removed. Regardless of the position or number of arranged ink cartridge dispensers 30, the ink agitator assembly 6 can agitate the ink across the whole width of the dispensed ink area. Thus, agitating of the ink is performed independent from ink dispensing.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method for supplying printing ink to a printing unit of a printing press, comprising:

arranging at least one ink cartridge dispenser carrying an ink cartridge on a linear support;

moving the at least one ink cartridge dispenser on the linear support by hand across a longitudinal axis of an ink fountain roller;

dispensing printing ink through an open end of the ink cartridge to a dispensed ink area;

rotating the ink fountain roller; and transporting the printing ink to the printing unit in the printing press.

2. The method of claim 1, wherein the at least one ink cartridge dispenser is stationary during printing.

3. The method of claim 1, further comprising the step of moving an ink agitator blade in the dispensed ink area across the longitudinal axis of the ink fountain roller.

4. The method of claim 3, further comprising the step of moving the ink agitator blade independently from the position of the at least one ink cartridge dispenser.

5. The method of claim 3, wherein the ink agitation blade can be turned off as desired.

6. The method of claim 1, further comprising the step of sensing an ink level in the dispensed ink area with an ink level sensor.

7. The method of claim 6, wherein the step of dispensing printing ink is controlled by a signal derived from the ink level.

8. The method of claim 6, wherein the at least one ink level sensor is stationary during a print job.

9. The method of claim 6, wherein a plurality of ink cartridges are arranged.

10. The method of claim 1, further comprising the step of:

manually actuating a clamp to secure or release the at least one ink cartridge from the linear support.

11. The method of claim 10, wherein the at least one ink cartridge slides along the linear support when the clamp is released.

12. The method of claim 10, the at least one ink cartridge is fixed to the linear support when the clamp is secured.

13. The method of claim 1, wherein very small amounts of ink are dispensed along the ink fountain at the same time.

14. The method of claim 1, wherein an operator moves the at least one ink cartridge by sliding the at least one ink cartridge along the linear support to a desired position.

15. The method of claim 1 further comprising the step of:

positioning the at least one ink cartridge dispenser by hand on the linear support.

16. The method of claim 1, wherein the at least one ink cartridge includes five ink cartridges.

17. The method of claim 1, wherein the linear support includes at least one stop or marking for identifying a desired position of the at least one ink cartridge dispensers.

18. A method for supplying printing ink to a printing unit of a printing press, comprising:

arranging a plurality of ink cartridge dispensers on a linear support, each ink cartridge dispenser carrying an ink cartridge;

moving the plurality of ink cartridge dispensers on the linear support by hand across a longitudinal axis of an ink fountain roller;

dispensing printing ink through an open end of the ink cartridges to a plurality of dispensed ink areas;

rotating the ink fountain roller; and transporting the printing ink to the printing unit in the printing press.

19. The method of claim 18, wherein there are 5 ink cartridge dispensers.

20. The method of claim 18, wherein the plurality of ink cartridge dispensers are positioned by hand in desired areas to provide spot color during printing.

* * * * *